US006220363B1

(12) United States Patent
Dallas

(10) Patent No.: US 6,220,363 B1
(45) **Date of Patent: *Apr. 24, 2001**

(54) WELLHEAD ISOLATION TOOL AND METHOD OF USING SAME

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 0 days.

This patent is subject to a terminal disclaimer.

(21) Appl. No.: 09/356,231

(22) Filed: Jul. 16, 1999

(51) Int. Cl.[7] ..... E21B 33/068

(52) U.S. Cl. ..... 166/382; 166/77.51; 166/85.3; 166/85.4

(58) Field of Search ..... 166/382, 386, 166/77.51, 85.3, 85.4, 90.1, 379, 380, 77.1

(56) References Cited

U.S. PATENT DOCUMENTS

| | | | |
|---|---|---|---|
| 3,830,304 | 8/1974 | Cummins | 166/305 |
| 4,111,261 | 9/1978 | Oliver | 166/86 |
| 4,241,786 | 12/1980 | Bullen | 166/77 |
| 4,632,183 | 12/1986 | McLeod | 166/77 |
| 4,867,243 | 9/1989 | Garner et al. | 66/379 |
| 5,332,044 | 7/1994 | Dallas et al. | 166/386 |
| 5,372,202 | 12/1994 | Dallas | 166/386 |
| 5,927,403 * | 7/1999 | Dallas | 166/77.51 |

FOREIGN PATENT DOCUMENTS

| | | | |
|---|---|---|---|
| 1277230 | 12/1990 | (CA) | 166/59 |
| 1281280 | 12/1991 | (CA) | 166/48 |
| 1292675 | 12/1991 | (CA) | 166/49 |
| 2055656 | 11/1993 | (CA) . | |

* cited by examiner

*Primary Examiner*—William Neuder
(74) *Attorney, Agent, or Firm*—Nelson Mullins Riley & Scarborough, LLP

(57) ABSTRACT

A wellhead isolation tool permitting a high fluid flow rate during a well treatment to stimulate production is described. The wellhead isolation tool includes a mandrel to be inserted into a wellhead. The mandrel is sealed in a tubing hanger above back pressure valve threads to isolate the pressure sensitive components of the wellhead from fluid pressure used in the well treatment, and has a lower section extending past the back pressure valve threads and tubing threads into the tubing to protect the threads from washout. The mandrel is locked down with a mechanical lockdown mechanism having a broad range of adjustment. The advantages are that no special tubing hanger is required for use with the mandrel, and a fluid flow rate enabled by the tool during the well treatment is significantly higher than a fluid flow rate enabled with conventional wellhead isolation tools.

32 Claims, 5 Drawing Sheets

WELLHEAD ISOLATION TOOL AND METHOD OF USING SAME

TECHNICAL FIELD

The present invention relates to equipment for servicing oil and gas wells and, in particular, to an apparatus for wellhead isolation permitting a high flow rate during a well treatment to stimulate production.

BACKGROUND OF THE INVENTION

Most oil and gas wells eventually require some form of stimulation to enhance hydrocarbon flow and make or keep them economically viable. The servicing of the oil and gas wells to stimulate production requires the pumping of fluids under high pressure. The fluids are generally corrosive and abrasive because they are frequently laden with corrosive acids and abrasive proppants such as sharp sand. Consequently, such fluids can cause irreparable damage to wellhead equipment if they are pumped directly through the spools and the various valves that make-up the wellhead. To prevent such damage, wellhead isolation tools have been used and various configurations are known. Examples of such tools are taught in at least the following patents and patent application:

U.S. Pat. No. 3,830,304 to Cummins;

U.S. Pat. No. 4,241,786 to Bullen;

U.S. Pat. No. 4,632,183 to McLeod;

U.S. Pat. No. 4,111,261 to Oliver;

U.S. Pat. No. 4,867,243 to Gardner et al.;

U.S. Pat. No. 5,332,044 to Dallas;

U.S. Pat. No. 5,372,202 to Dallas;

Canadian Patent No. 1,277,230 to McLeod;

Canadian Patent No. 1,281,280 to McLeod;

Canadian Patent No. 1,292,675 to McLeod;

Canadian Patent Application No. 2,055,656 to McLeod.

All of the wellhead isolation tools described in the patents and patent application listed above operate on the same general principle. Each tool includes a mandrel which is inserted through the various valves and spools of the wellhead to isolate those components from the elevated pressures and the corrosive and abrasive fluids used in the well treatment to stimulate production. A top end of the mandrel is connected to one or more high pressure valves through which the stimulation fluids are pumped. A bottom end of the mandrel includes a packoff assembly for achieving a fluid seal with the production tubing in the well. The mandrel is inserted down through the wellhead to the extent that it enters a top of the production tubing string where the packoff assembly seals against the inside of the production tubing, so that the wellhead is completely isolated from the stimulation fluids.

The mandrel for a wellhead isolation tool must be constructed to withstand high pressures at least about 10,000 psi. The packoff assembly that is bonded to the bottom end of the mandrel and seals against the inside of the production tubing limits the internal diameter of the mandrel and, consequently, the flow rate at which stimulation fluids are pumped through the mandrel is limited. For example, the maximum internal diameter for a mandrel of any one of the wellhead isolation tools described in the patents and patent application listed above is about 1.5" (3.8 cm) when designed for use with a wellhead and a production tubing of standard dimensions. If the stimulation fluids are pumped through a mandrel of that size at 200 feet per second, the fluid flow rate is about 26 barrels per minute (BPM).

Wellhead isolation tools having a packoff assembly that seals against the inside of the production tubing also suffer from other drawbacks. The packoff assembly has a tendency to catch on constrictions as it is inserted through the wellhead, because the packoff assembly that leads the way through the wellhead, is larger than the mandrel, and has a leading edge of rubberized sealing material that seals against the inside of production tubing. In addition, the joint between the mandrel and the packoff assembly creates eddies in the production stimulation fluids which cause washout in the area of the joint.

To overcome the drawbacks of the wellhead isolation tools described in the above-listed prior art, Applicant describes an improved mandrel for a wellhead isolation tool in his co-pending U.S. patent application Ser. No. 08/837,574 filed on Apr. 21, 1997 and entitled APPARATUS FOR INCREASING THE TRANSFER RATE OF PRODUCTION STIMULATION FLUIDS THROUGH THE WELLHEAD OF A HYDROCARBON WELL, the entire specification of which is incorporated herein by reference. The apparatus described in this patent application includes a mandrel for a wellhead isolation tool, and a tubing hanger for use in conjunction with the mandrel. The mandrel includes an annular seal bonded to the outside wall above the bottom end of the mandrel. The annular seal cooperates with the sealing surface in the top end of the tubing hanger to isolate the wellhead equipment from the high pressures and corrosive and abrasive materials pumped into the well during a well treatment to stimulate production. The novel construction for the mandrel and the tubing hanger eliminates the requirement for a packoff assembly attached to the bottom of the mandrel and thereby permits the mandrel to have a larger internal diameter for increasing the transfer rate of production stimulation fluids through the wellhead. However, the annular seal of the mandrel is not adapted to cooperate with a standard tubing hanger. Consequently, a special tubing hanger is required if the mandrel is to be used for wellhead isolation.

It is desirable to further improve wellhead isolation tools to permit a high flow rate during a well treatment to stimulate production, without a requirement for a special tubing hanger so that substantially any well can be treated to stimulate production.

SUMMARY OF THE INVENTION

It is an object of the invention to provide a wellhead isolation tool overcoming the drawbacks of prior art wellhead isolation tools and eliminating the requirement for a special tubing hanger.

It is another object of the invention to provide a wellhead isolation tool equipped with a mandrel that has a larger internal diameter for providing a high flow rate of production stimulation fluids through the wellhead.

It is a further object of the invention to provide a novel construction for a mandrel having a seal which functions reliably and may be packed off within a standard tubing hanger.

It is yet a further object of the invention to provide a wellhead isolation tool equipped with a mandrel that has a leading end which is not prone to catching on constrictions when the mandrel is inserted through the wellhead.

In accordance with one aspect of the invention, there is provided an apparatus for wellhead isolation, permitting a high flow rate during a well treatment to stimulate production, comprising:

a mandrel adapted to be inserted down into the wellhead to an operative position, the mandrel having an inner surface defining a passage, an outer surface including an upper section of a first diameter, a lower section of a second diameter smaller than the first diameter, a sealing shoulder between the upper and lower sections for supporting an elastomeric seal, the lower section extending past back pressure valve threads and tubing threads of a tubing hanger into an annulus of a tubing of the well which is supported by the tubing hanger and the elastomeric seal being in fluid tight sealing engagement with an annular step in the tubing hanger formed between lift threads and the back pressure valve threads when the mandrel is in the operative position.

The elastomeric seal in accordance with one embodiment of the invention preferably comprises a first O-ring seal received in an annular groove on the sealing shoulder of the mandrel, and a second O-ring seal received in an annular groove on the upper section adjacent the sealing shoulder, the sealing shoulder of the mandrel being contoured to conform to the annular step so that the first O-ring seal is sealingly engaged with a substantially radial surface of the annular step and the second O-ring seal is sealingly engaged with a substantially axial surface of the annular step when the mandrel is in the operative position.

In accordance with another embodiment of the invention, the elastomeric seal preferably covers the sealing shoulder, a portion of the upper section and a portion of the lower section adjacent the sealing shoulder while the sealing shoulder of the mandrel is preferably contoured to conform the annular step of the tubing hanger. The sealing shoulder of the mandrel preferably further includes an annular ridge which protrudes into the elastomeric seal to inhibit the seal from being extruded away from the sealing shoulder when the mandrel is in the operative position.

In more specific terms, the invention provides an apparatus for wellhead isolation which permits a high flow rate during a well treatment to stimulate production, comprising:

a mandrel adapted to be inserted down into the wellhead to an operative position, the mandrel having an inner surface defining a passage, an outer surface including an upper section of a first diameter, a lower section of a second diameter smaller than the first diameter, a sealing shoulder between the upper and lower sections for supporting an elastomeric seal, the lower section extending past back pressure valve threads and tubing threads of a tubing hanger into an annulus of a tubing of the well which is supported by the tubing hanger and the elastomeric seal being in fluid tight sealing engagement with an annular step in the tubing hanger formed between lift threads and the back pressure valve threads when the mandrel is in the operative position;

a mechanical lockdown mechanism for detachably securing the mandrel to the wellhead when the mandrel is in the operative position;

a hydraulic cylinder for inserting the mandrel into and removing the mandrel from the wellhead; and at least two elongated hydraulic cylinder support rods fixed relative to the wellhead for supporting the hydraulic cylinder in vertical and axial alignment with the wellhead, the support rods and the cylinder being removable when the mandrel is locked in the operative position.

The mechanical lockdown mechanism preferably includes a pair of complementary thread-engaging surfaces having respective axial lengths adequate to compensate for variations in length of a wellhead into which the mandrel is inserted to ensure the mandrel is locked in the operative position.

The advantage of the invention lies in that the elastomeric seal supported by the sealing shoulder of the mandrel is seated against an annular step of the tubing hanger which is located between the lift threads and the back pressure valve threads of a standard tubing hanger so that a special tubing hanger is not required to use the wellhead isolation tool. This reduces the cost of the wellhead equipment while enabling a high fluid flow rate during a well treatment to stimulate production of the well. A mandrel of the tool in accordance with the invention enables significantly higher flow rates during a well stimulation treatment. Furthermore, the elastomeric seal supported by the sealing shoulder of the mandrel in accordance with the invention provides a reliable fluid-tight seal.

BRIEF DESCRIPTION OF THE DRAWINGS

The invention will now be further explained by way of example only and with reference to the following drawings in which.

DETAILED DESCRIPTION OF THE PREFERRED EMBODIMENT

Figure 1:
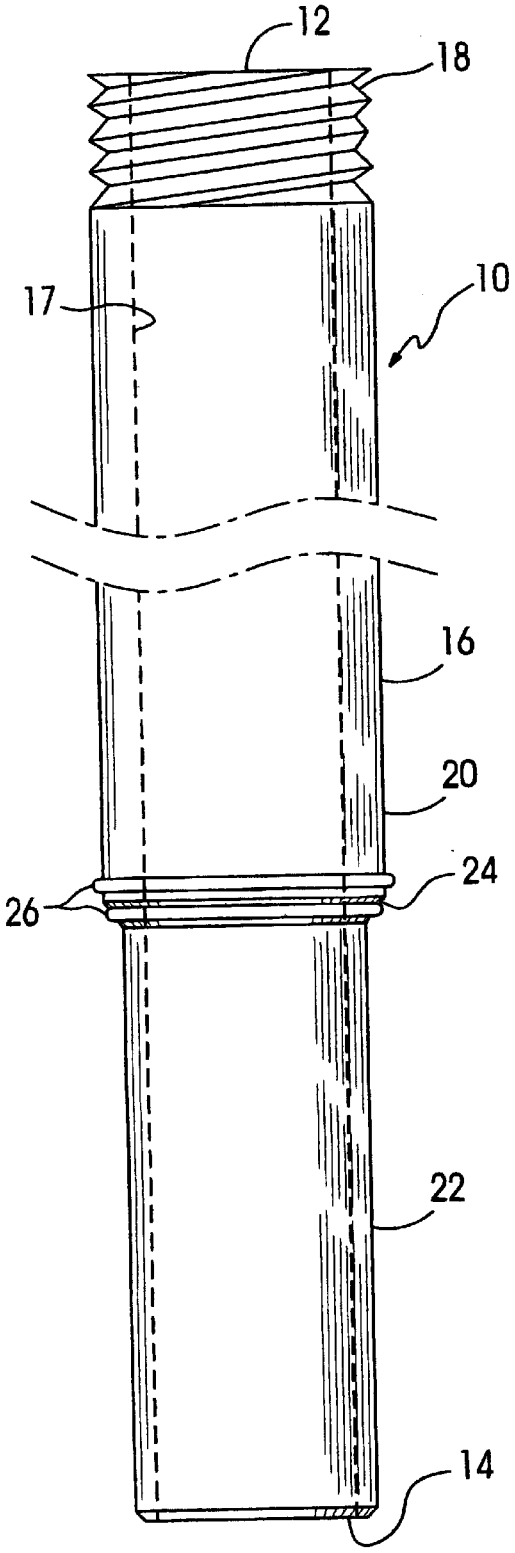
FIG. 1 is an elevational view of the mandrel of a wellhead isolation tool in accordance with a preferred embodiment of the invention.

FIG. 1 shows an elevational view of a mandrel 10 in accordance with a preferred embodiment of the invention. The mandrel 10 may be adapted for use with any known configuration of a wellhead isolation tool. The mandrel 10 is a length of high pressure tubing well known in the art, having a top end 12, a bottom end 14 and an outer surface 16 with a fluid passage 17 that extends between the top end 12 and the bottom end 14. The top end 12 includes a threaded connector 18 for connection with a mandrel head, which will be explained below with reference to FIG. 4*a*.

The outer surface 16 of the mandrel 10 includes an upper section 20 having a first diameter, and a lower section 22 having a second diameter smaller than the first diameter. A sealing shoulder 24 is formed between the upper and the lower sections and supports elastomeric O-ring seals 26, which will be explained in detail with reference to FIG. 3*a*. The bottom end 14 of the mandrel 10 is preferably bevelled, and the bevelled end 14 together with the reduced diameter of the lower section 22 of the outer surface of the mandrel, facilitates entrance of mandrel 10 through the back pressure threads of a tubing hanger, as will be explained below with reference to FIG. 2.

Figure 2:
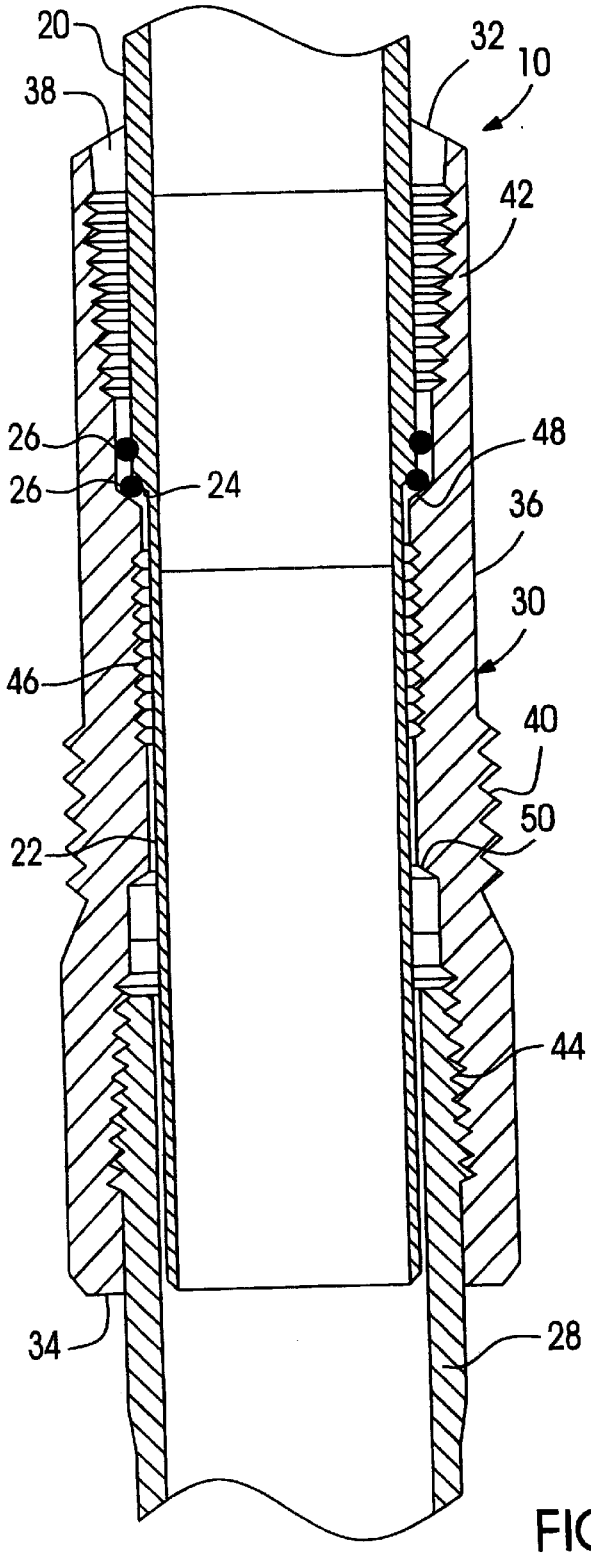
FIG. 2 is a partial cross-sectional view of the mandrel, shown in FIG. 1, in an operative position in which the mandrel is inserted into a top of a tubing and sealed with a tubing hanger that receives and supports the tubing.

FIG. 2 shows a partial cross-sectional view of a lower portion of the mandrel 10 in an operative position in which the mandrel 10 is inserted into the top end of a production tubing 28 and sealed with a tubing hanger 30 that receives and supports the production tubing 28. Generally, the production tubing string of a well is connected at the top to a tubing hanger or tubing coupler which is supported within the tubing spool of the wellhead. The tubing hanger 30 is of standard type, typical for a back pressure hanger design, and does not include a surface designed for sealing engagement with a wellhead isolation tool. Consequently, the high pressure tubing of wellhead isolation tools is traditionally packed off inside the production tubing 28, as described in the prior art. Alternatively, the standard tubing hanger 30 may be replaced by the special tubing hanger described in Applicant's U.S. patent application Ser. No. 08/837,574 to provide a sealing surface for packing off the mandrel of the wellhead isolation tool.

Figure 5:
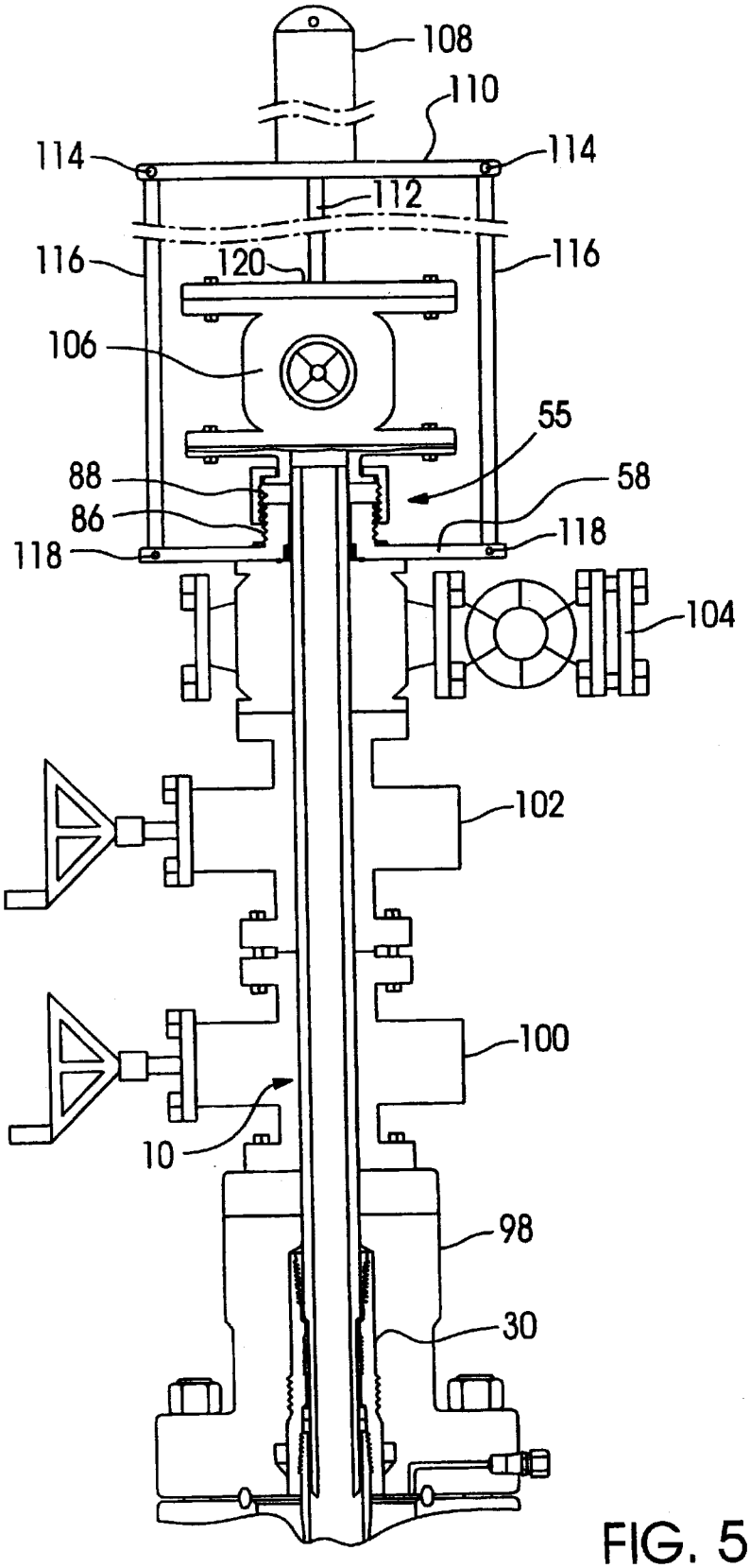
FIG. 5 is a schematic view of the wellhead isolation tool mounted to a wellhead, the mandrel of the wellhead isolation tool being in the operative position shown in FIG. 2.

The standard tubing hanger 30 is well known in the art and includes a cylindrical body made of steel which has a top end 32, a bottom end 34, an outer wall 36 and a fluid passage 38 that extends from the top end 32 to the bottom end 34 for fluid communication through the tubing hanger. Acme threads 40 are provided on the outer wall 36 for connection with an adapter or spool, as illustrated in FIG. 5. The shape and configuration of the tubing hanger 30, particularly of the outer wall 36, will depend upon the shape and configuration of the tubing spool in which the tubing hanger 30 is received and supported. Nevertheless, the tubing hanger 30 generally includes threaded surfaces in the fluid passage 38 for different connection functions. Tapered lift threads 42 are provided on an upper portion of the inside of tubing hanger 30 for connection of tools to lift the tubing hanger. Tubing threads 44 are provided on a lower portion of the inside of tubing hanger 30 for connection of the production tubing 28, as shown in FIG. 2. Back pressure valve threads 46 are provided between the lift threads 42 and the tubing threads 44, permitting the installation of a back pressure valve in the fluid passage 38, so that a blowout preventer can be safely removed from the wellhead. Two annular steps 48 and 50 form respective transitions between the different portions of the inside of the tubing hanger 30. In accordance with the present invention, the sealing shoulder 24 of the outer surface of the mandrel which supports the elastomeric O-ring seals 26 packs off against the annular step 48 so that the mandrel 10 can be used with a standard tubing hanger to eliminate the requirement for a special tubing hanger to achieve a high flow rate wellhead isolation tool. When the mandrel 10 is inserted into the wellhead in the operative position as shown in FIG. 2, the elastomeric O-ring seals 26 supported by the sealing shoulder 24 are securely seated against the annular step 48 of the tubing hanger 30 between the lift threads 42 and the back pressure valve threads 46. In this operative position, the lower section 22 of the mandrel 10 extends downwardly past the back pressure valve threads 46 and the tubing threads 44 into the production tubing 28. Thus, the back pressure valve threads 46 and the tubing threads 44 are protected by the lower section 22 from washout by abrasive proppants pumped into the well during a well treatment to stimulate production.

Figure 3A:
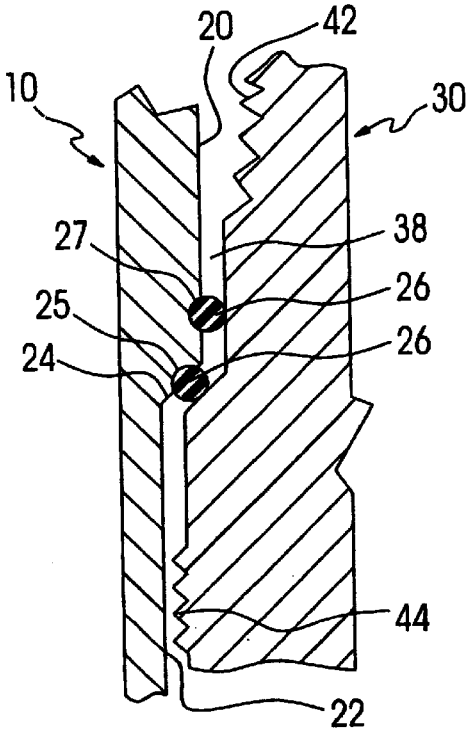
FIG. 3*a* which appears on sheet 1 of the drawings is a partial cross-sectional view of the mandrel shown in FIG. 1, showing the sealing engagement between the mandrel and the tubing hanger.

FIG. 3*a* illustrates the detail of the elastomeric O-ring seals 26 shown in FIG. 2. The elastomeric O-ring seals 26 include a first O-ring seal received in an annular groove 25 on the sealing shoulder 24 and a second O-ring seal received in an annular groove 27 on the upper section 20 adjacent to the sealing shoulder 24. The sealing shoulder 24 of the mandrel 10 is contoured to conform the annular step 26 so that the first O-ring seal in the annular groove 25 sealingly engages a substantial radial surface of the annular step 48 and the second O-ring seal sealingly engages a substantial axial surface of the annular step when the mandrel 10 is in the operative position. Elastomeric O-ring seals 26 suitable for high pressure applications (10,000–15,000 psi) are commercially available and well known in the art.

Figure 3B:
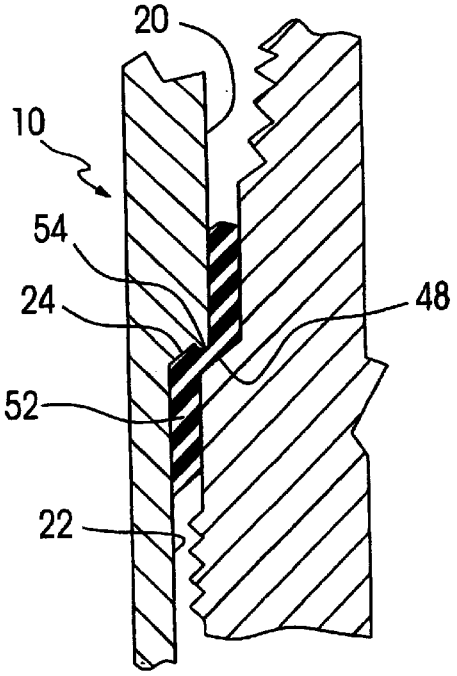
FIG. 3*b* which also appears on sheet 1 of the drawings is a partial cross-sectional view of a mandrel in accordance with a second embodiment of the invention, showing the sealing engagement between the mandrel and the tubing hanger.

FIG. 3*b* shows an elastomeric seal on the mandrel 10 in accordance with a second preferred embodiment of the invention. In this embodiment, the mandrel 10 is provided with an improved elastomeric seal as described in Applicant's co-pending U.S. patent application Ser. No. 09/299,551, filed on Apr. 26, 1999 and entitled HIGH PRESSURE FLUID SEAL FOR SEALING AGAINST A BIT GUIDE IN A WELLLHEAD AND METHOD OF USING, which is incorporated herein by reference. The high pressure fluid seal 52 is an elastomeric material preferably made from a plastic material such as polyethylene or a rubber compound such as nitryl rubber. The elastomeric material preferably has a hardness of about 80–100 durometers. The high pressure fluid seal 52 is bonded directly to the sealing shoulder 24 of the mandrel 10 in a well known manner in the art and covers the sealing shoulder 24, a portion of the upper section 20 and a portion of the lower section 22 adjacent the sealing shoulder. The sealing shoulder 24 of the mandrel 10 is also preferably contoured to conform the annular step 48 of the tubing hanger. The sealing shoulder 24 of the mandrel 10 may further include at least one downwardly protruding annular ridge 54 which provides an area of increased compression of the high pressure fluid seal 52 in an area preferably adjacent the upper section 20 of the outer surface 16 of the mandrel. The annular ridge 54 not only provides an area of increased compression, it also inhibits extrusion of the high pressure fluid seal 52 from the sealing shoulder 24 when the mandrel 10 is the operative position and exposed to extreme fluid pressures. The annular ridge 54 likewise helps ensure that the high pressure fluid seal 52 securely seats against the annular step 48, even if the annular step 48 is worn due to impact and abrasion resulting from the movement of well tools into or out of the tubing hanger 30.

Figure 4A:
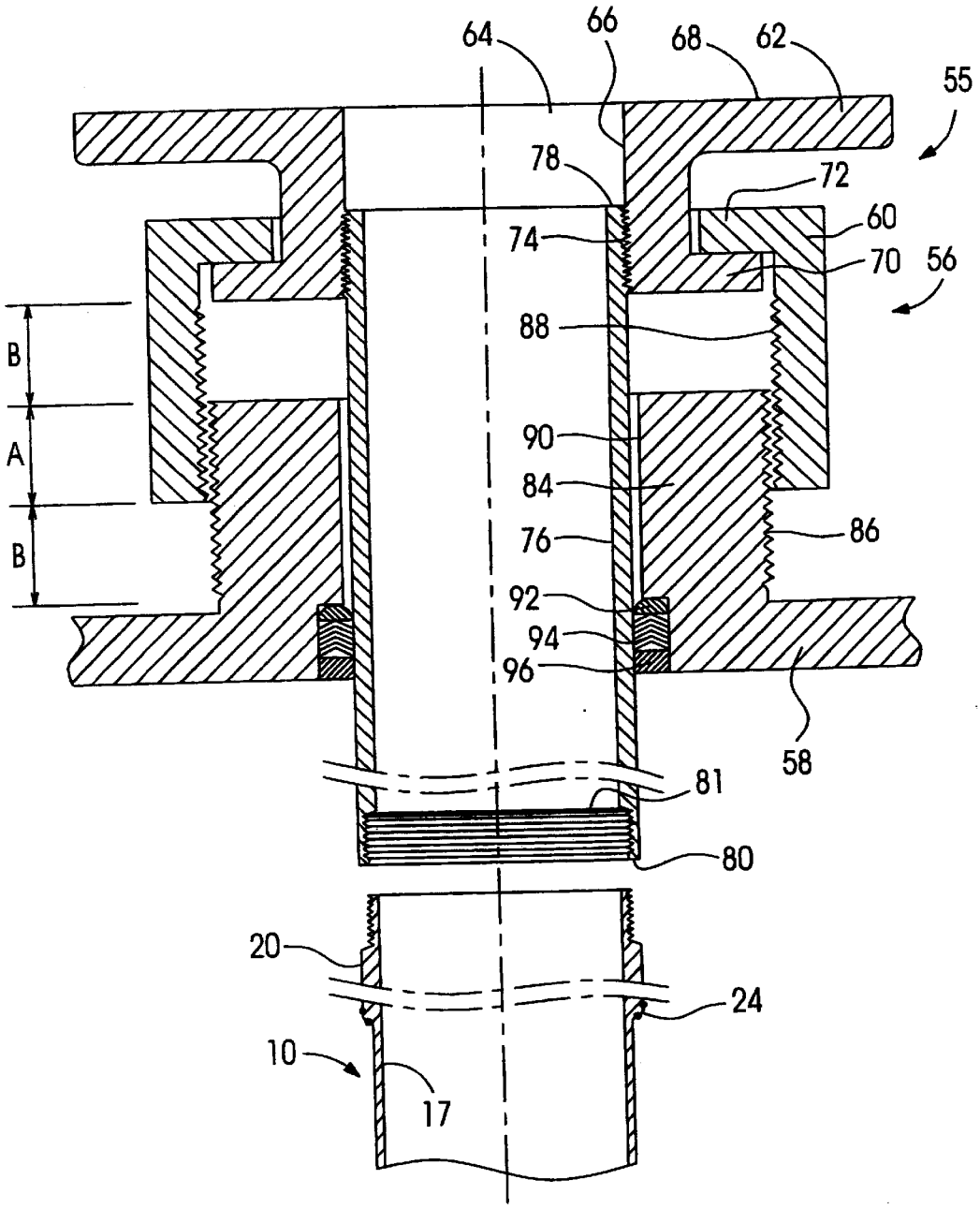
FIG. 4*a* is a partial cross-sectional view of the wellhead isolation tool in accordance with the invention, showing the mechanical lockdown mechanism in a locked position.

FIG. 4*a* shows a wellhead isolation tool 55 including a mechanical lockdown mechanism 56 in accordance with a preferred embodiment of the invention. The mechanical lockdown mechanism 56 is used to lock the mandrel 10 in the operative position as shown in FIG. 2. As discussed above, because the sealing shoulder 24 with the elastomeric O-ring seals is packed off against the fixed-point annular step 48 of the tubing hanger, the mandrel 10 is required to be accurately positioned and securely locked in this operative position. Consequently, a lockdown mechanism 56 must be provided to compensate for variations in a length of the mandrel 10 and a distance from the annular step 48 of the tubing hanger 30 to the top of the wellhead in different wellheads, as described in Applicant's co-pending U.S. patent application, filed Jun. 23, 1999 and entitled BLOWOUT PREVENTER PROTECTOR AND SETTING TOOL, which is also incorporated herein by reference. The mechanical lockdown mechanism 56 includes a base plate 58 and a lockdown nut 60 which detachably interconnects the base plate 58 and a mandrel head 62. The mandrel head 62 is an annular flange, having a central passage 64 defined by an internal wall 66. An upper flange 68 is adapted for connection of equipment, such as a high pressure valve, which will be described below in more detail. A lower flange 70 retains a top flange 72 of the lockdown nut 60. Spiral threads 74 are provided on the lower end of the internal wall 66, so that the mandrel head 62 may be securely attached to the threaded top end 12 of the mandrel 10 (FIG. 1), or a threaded top end 78 of mandrel extension 76, as illustrated in FIG. 4*a*. The mandrel 10 may include one or more mandrel extensions 76. Each mandrel extension 76 has the threaded top end 78 and a threaded bottom end 80. The threaded top end 78 is adapted to connect the mandrel head 62 or another mandrel extension 76, and the threaded bottom end 80 is adapted to connect the mandrel 10 or another mandrel extension 76. Those connections are in a fluid tight sealing relationship provided by O-rings, one of which, for example, is indicated by reference numeral 81. The mandrel extension 76 has an outer diameter equal to the diameter of the upper section 20 of the outer surface 16 of the mandrel 10 and an internal diameter equal to the internal diameter of the passage 17 of the mandrel 10.

The central passage 64 of the mandrel head 62 is in full communication with the passage 17 of the mandrel 10 when the mandrel head 62, the mandrel extension 76 and the mandrel 10 are securely assembled. The central passage 64 has an internal diameter not smaller than the passage 17 of the mandrel 10.

The base plate 58 is preferably a circular disc which includes an integral concentric sleeve 84 perpendicular to the base plate 58. Spiral threads 86 on the exterior of the integral sleeve 84 are provided, and engageable with complementary spiral threads 88 on the interior surface of the lockdown nut 60. The base plate 58 and the integral sleeve 84 provide a passage 90 to permit the mandrel 10 and the mandrel extension 76 to pass therethrough. The lockdown nut 60 secures the mandrel head 62 from movement with respect to the base plate when the lockdown nut engages the spiral threads 86 of the integral sleeve 84. The mandrel head 62 with its upper and lower flanges 68, 70, and the lockdown nut 60 with its top flange 72 are illustrated in FIG. 4*a* as an integral unit assembly, for example, by welding, or the like. However, persons skilled in the art will understand that either one of the mandrel head 62 and the lockdown nut 60 may be constructed to permit disassembly to enable the mandrel head 62 or the lockdown nut 60 to be independently replaced.

The passage 90 through the base plate 58 has a recessed region on the lower end for receiving a steel spacer 92 and packing rings 94 preferably constructed of brass, rubber and fabric. The steel spacer 92 and packing rings 94 define a passage of the same diameter as the periphery of the mandrel 10 or the mandrel extension 76. The steel spacer 92 and the packing rings are removable and may be interchanged to accommodate different sizes of mandrel 10 or mandrel extension 76. The steel spacer 92 and the packing rings 94 are retained in the recessed region by a retainer nut 96. The combination of the steel spacer 92, packing rings and the retainer nut 96 provides a fluid seal to prevent passage to atmosphere of well fluids between the exterior of the mandrel 10 or mandrel extension 76 and the interior of the wellhead when the mandrel 10 and the mandrel extension 76 are inserted into the wellhead, which will be described below with reference to FIG. 6.

Figure 4B:
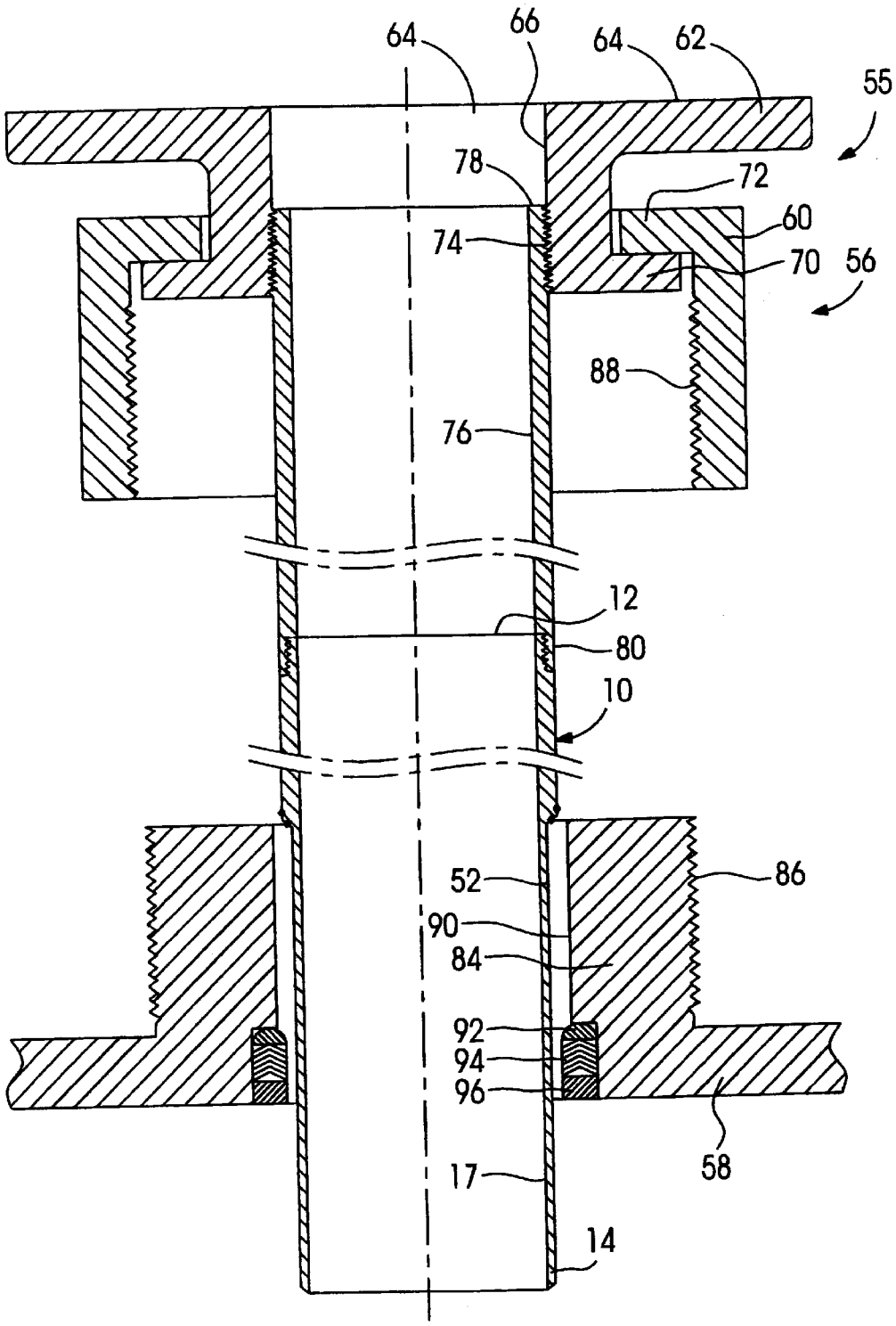
FIG. 4*b* is a partial cross-sectional view of the wellhead isolation tool in FIG. 4*a,* showing the mechanical lockdown mechanism in an unlocked position.

FIG. 4*b* illustrates the mechanical lockdown mechanism 56 assembled with the mandrel 10 and the mandrel extension 76 prior to being mounted atop a wellhead for a well stimulation treatment. The lockdown nut 60 is disengaged from the integral sleeve 84 of the base plate 58 and the mandrel head 62 is connected to the threaded top end 78 of the mandrel extension 76. The mandrel extension 76 is connected to the treaded bottom end 80 of the mandrel 10 to provide the required length for particular wellhead. Hereafter, for the purpose of convenience, the assembled combination of the mandrel 10 and mandrel extension 76 is referred to as an "assembled mandrel". The base plate 56 is mounted to the top end of the wellhead (FIG. 5) and the combination of the lockdown nut 60, the mandrel head 62 and the assembled mandrel is inserted from the top into the wellhead, using any one of several setting tools known in the art.

FIG. 5 illustrates the wellhead isolation tool 55 and a hydraulic setting tool used to insert the wellhead isolation tool 55 to the operative position for a well treatment to stimulate production. The hydraulic setting tool illustrated in FIG. 5 was described in Applicant's U.S. Pat. No. 4,867,243 entitled WELLHEAD ISOLATION TOOL AND SETTING AND METHOD OF USING SAME which issued on Sep. 19, 1989 and is incorporated herein by reference. The wellhead is constructed in a well known manner from a series of valves and related flanges. The wellhead schematically illustrated in FIG. 5 includes a tubing spool 98 which receives and supports the tubing hanger 30. Connected by flange connections to the top of the tubing spool 98, are a pair of valves 100 and 102, by way of example. A third valve 104 is connected to the valve 102. The purpose of the three valves 100, 102 and 104 is to control the flow of hydrocarbons from the well. As described above, the wellhead isolation tool 55 is mounted above the wellhead, that is, atop the valve 104. Mounted above the wellhead isolation tool 55, is a high pressure valve 106 which is used for fluid flow control during the well treatment to stimulate production, and is also used to prevent well fluids from escaping to atmosphere from the top of the wellhead isolation tool 55 during insertion and removal of the assembled mandrel. The hydraulic setting tool includes a hydraulic cylinder 108 which is mounted to a support plate 110. The support plate 110 includes a central bore (not shown) to permit a piston rod 112 of the hydraulic cylinder 108 to pass through the support plate 110. The support plate 110 also includes at least two spaced apart attachment points 114 for attachment of respective hydraulic cylinder support rods 116. The spaced apart attachment points 114 are preferably equally spaced from the central bore to ensure that the hydraulic cylinder 108 and the piston rod 112 are aligned with the wellhead to which the hydraulic cylinder 108 is mounted. The hydraulic cylinder support rods 116 are respectively attached on their lower ends to corresponding attachment points 118 on the base plate 58, which is mounted to the top of the valve 104. As is apparent, the base plate 58 and the support plate 110 have a periphery that extends beyond the wellhead to provide enough radial offset of the cylinder support rods 116 to accommodate the high pressure valves 106. The cylinder support rods 116 are identical in length and are attached to respective spaced apart attachment points 114, 118 on the support plate 110 and base plate 58 by means of thread fasteners or pins (not shown). The piston rod 112 is attached to the top of the high pressure valve 106 by a connector 120 so that mechanical force can be applied to the top of the wellhead isolation tool 55 and the attached high pressure valve 106 to stroke the assembled mandrel in and out of the wellhead.

As noted above, mandrel extensions 76 are optional and of variable length so that the assembled mandrel has adequate length to ensure that the top end 12 of the assembled mandrel extends above the top of the valve 104 just enough to enable the mandrel to be secured by the lockdown mechanism 56 described above when the elastomeric O-ring seals 26 are packed off against the annular step 48 of the tubing hanger. However, the distance from the annular step 48 of the tubing hanger 30 to the top of the valve 104 may vary to some extent in different wellheads. This variation cannot be reliably accommodated by a conventional lockdown mechanism such as taught in applicant's U.S. Pat. No. 4,867,243.

The mechanical lockdown mechanism 56 is configured to provide a broader range of adjustment to compensate for variations in the distance from the top of the valve 104 to the top end of the assembled mandrel. The complementary spiral threads 86 and 88 on the respective integral sleeve 84 and lockdown nut 60 having an adequate length to provide the required compensation. Preferably, the respective threads 86 and 88 are at least about 9" (22.86 cm) in length. A minimum engagement for safely containing elevated fluid pressures acting on the wellhead isolation tool 55 during a well treatment to stimulate production is represented by a section A, shown in FIG. 4*a*. Sections B represents the adjustment available to compensate for variations in the distance from the top of the valve 104 to the top end of the assembled mandrel. Spiral threads with about 9" of axial length provide about 5" of adjustment while ensuring that a minimum engagement of the lockdown nut 60 is maintained.

Figure 6A:
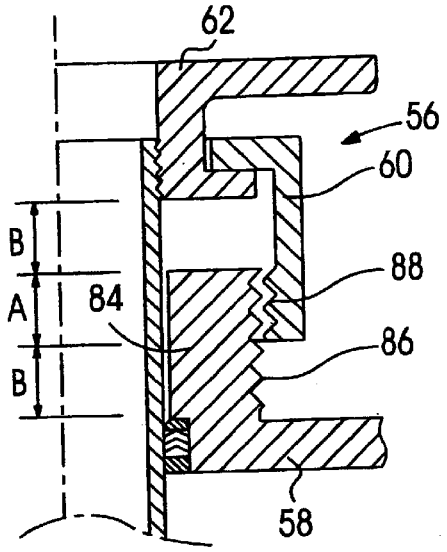
FIG. 6*a* which appears on sheet 2 of the drawings is a partial cross-sectional view of the mechanical lockdown mechanism in accordance with another embodiment of the invention.
Figure 6B:
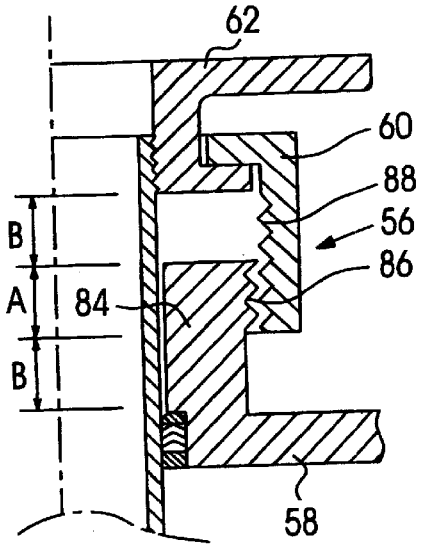
FIG. 6*b* which also appears on sheet 2 of the drawings is a partial cross-sectional view of the mechanical lockdown mechanism in accordance with a further embodiment of the invention.

FIGS. 6*a* and 6*b* illustrate two of the alternate mechanical lockdown mechanisms 56 in accordance with the invention. In FIG. 6*a,* the spiral threads 88 on the lockdown nut 60 has an axial extent A adequate to ensure the minimum engagement required for safety, and the threads 86 on the integral sleeve 84 of the base plate 58 have full length spiral threads, which include the A section for the minimum engagement and the B section for the adjustment. The mechanical lockdown mechanism 56 illustrated in FIG. 6*b* provides a similar adjustable lockdown with length A for minimum safe threaded engagement on the integral sleeve 84 and full length spiral threads 88 including sections A and B on the lockdown nut 60 for the adjustment.

In use of the wellhead isolation tool 55, the base plate 58 is secured in a fluid sealing relationship to the top of the valve 104 with the lockdown nut 56 is disengaged from the integral sleeve 84 of the base plate 58, as shown in FIG. 4*b*. The combination of the assembled mandrel, mandrel head 62 and the lockdown nut 60 may be supported by a rig or other insertion tool. The high pressure valve 106 is mounted to the top flange 68 of the mandrel head before insertion of the assembled mandrel into the wellhead. The high pressure valve 106 is closed to prevent well fluids from escaping from the wellhead isolation tool 55 when the assembled mandrel is inserted into the wellhead. The valves 104, 102 and 100 are fully opened in sequence to permit the insertion of the assembled mandrel. The assembled mandrel may be inserted through the wellheads using the hydraulic cylindrical setting tool illustrated in FIG. 5 or any other of a plurality of insertion tools well known in the art. If the hydraulic insertion tool is used, the hydraulic cylinder 108, support plate 110 and the cylinder support rods 116 are mounted on the top of the wellhead so that the hydraulic cylinder 108 is supported in vertical and axial alignment with the wellhead with the piston rod 112 connected by the connector 120 to the top of the high pressure valve 106 and the cylinder support rods 116 are attached at their lower ends to the respective attachments points 118 on the base plate 58. During insertion of the assembled mandrel, well fluids are prevented from escaping to the atmosphere by the packing rings 94 in the base plate 58, which was described above with reference to FIG. 4*a*. The assembled mandrel is inserted into the wellhead until the elastomeric O-ring seals 26 sealingly contact the annular step 48 of the tubing hanger 30 and the lockdown nut 60 is rotated down to its locking position so that the assembled mandrel is securely held in the operative position during the entire well treatment to stimulate production.

After the assembled mandrel is inserted into the operative position, the hydraulic setting tool is removed from the wellhead and the well treatment to stimulate production may begin. The efficacy of the wellhead isolation tool in accordance with the invention is illustrated in Table I. The fluid flow rates are expressed in barrels per minute (bpm) based on a maximum flow rate of 200 feet per second in different production tubings having standard internal diameters (I.D.).

TABLE I

| Production | Prior Art Isolation Tool | | Isolation Tool In Accordance With Invention | |
|---|---|---|---|---|
| Tubing I.D. | I.D. | Flow Rate | I.D. | Flow Rate |
| 2⅜" | 1.25" | 18 bpm | 1.5" | 26 bpm |
| 2⅞" | 1.5" | 26 bpm | 1.75" | 36 bpm |
| 3½" | 1.75" | 36 bpm | 2.0" | 48 bpm |

As is apparent, flow rates are significantly improved and the time required to stimulate a well is correspondingly reduced.

The hydraulic setting tool is remounted to the wellhead after the well treatment to stimulate production is completed. The hydraulic setting tool is then operated to stroke the assembled mandrel upward out of the top of the valve 104. The valves 104, 102 and 100 are closed to prevent well fluids from escaping to the atmosphere. After the valves 104, 102 and 100 are closed, the entire assembly of the wellhead isolation tool 55 and the high pressure valve 106 as well as the hydraulic setting tool are removed from the top of the valve 104. The sequence of steps described above may be changed to adapt to specific circumstances, as will be apparent to persons skilled in the art.

Although a hydraulic setting tool as described above with reference to FIG. 5 has been used to illustrate the use of the preferred embodiment of the invention, as noted above other types of setting tool may be used for inserting the assembled mandrel through the wellhead to the operative position. For example, a setting tool described by McLeod in U.S. Pat. No. 4,632,183, entitled INSERTION DRIVE SYSTEM FOR TREE SAVERS which issued on Dec. 5, 1984, the entire specification of which is incorporated herein by reference, may be used. Another type of setting tool which may also be used to insert the assembled mandrel is described by Bullen in U.S. Pat. No. 4,241,786, entitled WELL TREE SAVER, which issued on May 2, 1979 and is also incorporated herein by reference.

Modifications and improvements to the above-described embodiments of the invention may become apparent to those skilled in the art. The foregoing description is intended to be exemplary rather than limiting. The scope of the invention is therefore intended to be limited solely by the scope of the appended claims.

We claim:

1. An apparatus for wellhead isolation, permitting a high flow rate during a well treatment to stimulate production, comprising:

a mandrel adapted to be inserted down into the wellhead to an operative position, the mandrel having an inner surface defining a passage, an outer surface including an upper section of a first diameter, a lower section of a second diameter smaller than the first diameter, a sealing shoulder between the upper and lower sections for supporting an elastomeric seal, the lower section extending past back pressure valve threads and tubing threads of a tubing hanger (into an annulus of a tubing which is supported by the tubing hanger) and the elastomeric seal being in fluid tight sealing engagement with an annular step in the tubing hanger formed between lift threads and the back pressure valve threads when the mandrel is in the operative position.

2. An apparatus as claimed in claim 1 wherein the elastomeric seal comprises a first O-ring seal received in an annular groove on the sealing shoulder of the mandrel and a second O-ring seal received in an annular groove on the upper section adjacent the sealing shoulder, the sealing shoulder of the mandrel being contoured to conform to the annular step so that the first O-ring seal is sealingly engaged with a substantially radial surface of the annular step and the second O-ring seal is sealingly engaged with a substantially axial surface of the annular step when the mandrel is in the operative position.

3. An apparatus as claimed in claim 1 wherein the elastomeric seal covers the sealing shoulder, a portion of the upper section and a portion of the lower section adjacent the sealing shoulder.

4. An apparatus as claimed in claim 3 wherein the sealing shoulder of the mandrel is contoured to conform to the annular step of the tubing hanger.

5. An apparatus as claimed in claim 4 wherein the sealing shoulder of the mandrel includes an annular ridge which protrudes into the elastomeric seal to inhibit the seal from being extruded away from the sealing shoulder when the mandrel is in the operative position.

6. An apparatus as claimed in claim 5 wherein the annular ridge is located adjacent to the upper section of the outer surface of the mandrel.

7. An apparatus as claimed in claim 1 wherein the mandrel includes a mandrel head mounted to a threaded top end of the mandrel, the mandrel head including a passage that has an internal diameter not smaller then the passage of the mandrel which is in fluid communication with the passage of the mandrel.

8. An apparatus as claimed in claim 7 wherein the mandrel includes one or more mandrel extensions, each mandrel extension having a threaded top end and a threaded bottom end, the threaded top end being adapted to connect the mandrel head or another mandrel extension and the threaded bottom end being adapted to connect the mandrel or another mandrel extension.

9. An apparatus as claimed in claim 8 further comprises a mechanical lockdown mechanism for detachably securing the mandrel head to the wellhead, the lockdown mechanism being adapted to ensure that the elastomeric seal is securely seated against the annular step of the tubing hanger when the mandrel is in the operative position.

10. An apparatus as claimed in claim 9 wherein the mechanical lockdown mechanism comprises a base member fixed relative to the wellhead, the base member having a central passage to permit the insertion of the mandrel down into the wellhead and an elongated spiral thread for adjustably engaging a complementary thread of a lockdown nut which is adapted to lock the mandrel in the operative position.

11. An apparatus as claimed in claim 10 wherein the elongated spiral thread and the complementary thread of the lockdown nut have respective axial lengths adequate to compensate for variations in a distance between a top of the wellhead and the annular step of the tubing hanger of the different wellheads to permit the mandrel to be secured in the operative position even if a length of the mandrel is not precisely matched with a particular wellhead.

12. An apparatus as claimed in claim 11 wherein the mandrel head has a mandrel head bottom end received by the lockdown nut for detachably securing the mandrel head to the base member, a mandrel head top end being adapted to permit connection of equipment to the top end of the mandrel or the mandrel extension.

13. An apparatus as claimed in claim 12 wherein the base member includes a sealing device to prevent a passage of well fluids to atmosphere from a space between the outer surface of the mandrel and an interior of the wellhead when the mandrel is inserted into the wellhead.

14. An apparatus as claimed in claim 10 wherein the base member includes a base plate having an elongated sleeve perpendicular to the base plate, an interior of the sleeve forming the central passage and an exterior of the sleeve forming the elongated spiral thread, the base plate being adapted to be detachably mounted to the top of the wellhead.

15. An apparatus as claimed in claim 14 further comprising a hydraulic cylinder for inserting the mandrel into and removing the mandrel from the wellhead; and at least two elongated hydraulic cylinder support rods fixed relative to the base plate for supporting the hydraulic cylinder in vertical and axial alignment with the wellhead, the support rods and the hydraulic cylinder being removable when the mandrel is locked in the operative position.

16. An apparatus as claimed in claim 15 wherein the hydraulic cylinder is mounted to a support plate having a central bore to permit the passage of a piston rod of the cylinder therethrough for the insertion and removal of the mandrel, the elongated cylinder support rods being attached at one end to spaced-apart points on the support plate and at the other end to respectively opposing points on the base plate, the support plate being removable with the hydraulic cylinder and the elongated cylinder support rods after the mandrel is locked in the operative position.

17. An apparatus for wellhead isolation, permitting a high flow rate during a well treatment to stimulate production, comprising:

a mandrel adapted to be inserted down into the wellhead to an operative position, the mandrel having an inner surface defining a passage, an outer surface including an upper section of a first diameter, a lower section of a second diameter smaller than the first diameter, a sealing shoulder between the upper and lower sections for supporting an elastomeric seal, the lower section extending past back pressure valve threads and tubing threads of a tubing hanger (into an annulus of a tubing which is supported by the tubing hanger) and the elastomeric seal being in fluid tight sealing engagement with an annular step in the tubing hanger formed between the lift threads and the back pressure valve threads when the mandrel is in the operative position;

a mechanical lockdown mechanism for detachably securing the mandrel to the wellhead when the mandrel is in the operative position;

a hydraulic cylinder for inserting the mandrel into and removing the mandrel from the wellhead; and at least two elongated hydraulic cylinder support rods fixed relative to the wellhead for supporting the hydraulic cylinder in vertical and axial alignment with the wellhead, the support rods and the cylinder being removable when the mandrel is locked in the operative position.

18. An apparatus as claimed in claim 17 further comprising:

a base member adapted for attachment to a top of the wellhead, the base member including a passage to permit the insertion of the mandrel and at least two spaced-apart points of attachment for the elongated cylinder support rods, the points of attachment being equidistant from the passage; and the hydraulic cylinder being mounted to a support plate having a bore to permit the passage of a piton rod of the hydraulic cylinder therethrough, and at least two spaced-apart points of attachment for the elongated cylinder support rods, the points of attachment being complementary with the points of attachment on the base member, the support plate being removable with the hydraulic cylinder and the elongated cylinder support rods from the base member after insertion of the mandrel to the operative position.

19. An apparatus as claimed in claim 18 wherein the base member includes an elongated perpendicular sleeve that surrounds the passage through the base member, the elongated sleeve having an exterior wall with a spiral thread for engagement with a complementary spiral thread of a lockdown nut that is adapted to lock the mandrel in the operative position.

20. An apparatus as claimed in claim 19 wherein the spiral thread on the sleeve and the complementary spiral thread on the lockdown nut have respective axial lengths adequate to compensate for variations in length of a wellhead into which the mandrel is inserted.

21. An apparatus as claimed in claim 18 wherein the base member includes a seal adapted to prevent the passage to atmosphere of well fluids in a space between the outer surface of the mandrel and an interior of the wellhead when the mandrel is inserted into the wellhead.

22. An apparatus as claimed in claim 21 wherein a mandrel head is mounted to a top end of the mandrel, the mandrel head having a mandrel head bottom end received by the lockdown nut for detachably securing the mandrel to the base member, a mandrel head top end adapted to be connected to the piston rod of the hydraulic cylinder, and a passage from the mandrel head top end to the mandrel head bottom head in fluid communication with the mandrel when the mandrel is connected to the mandrel head.

23. An apparatus as claimed in claim 22 wherein the top end of the mandrel is adapted to permit connection of a mandrel extension to permit a length of the mandrel to be increased and the mandrel head is connected to a last of the mandrel extensions.

24. An apparatus as claimed in claim 17 wherein the elastomeric seal comprises a first and a second O-ring seals supported at the sealing shoulder of the mandrel, the sealing shoulder of the mandrel being contoured to conform to the annular step so that the first O-ring seal is sealingly engaged with a substantially radial surface of the annular step and the second O-ring seal is sealingly engaged with a substantially axial surface of the annular step when the mandrel is in the operative position.

25. An apparatus as claimed in claim 17 wherein the elastomeric seal covers the sealing shoulder, a portion of the upper section and a portion of the lower section adjacent the sealing shoulder, and the sealing shoulder includes an annular ridge which protrudes into the elastomeric seal to inhibit the seal from being extruded away from the sealing shoulder when the mandrel is in the operative position.

26. A method of wellhead isolation, permitting a high fluid flow rate during a well treatment to stimulate production, comprising the steps of:

a) mounting to a top of the wellhead in a fluid sealing relationship an apparatus for protecting the wellhead from exposure to fluid pressures, abrasive and corrosive fluids during a well treatment to stimulate production, comprising a mandrel adapted to be inserted down into the wellhead, the mandrel having an inner surface defining a bore, an outer surface including an upper section of a first diameter, a lower section of a second diameter smaller than the first diameter, a sealing shoulder between the upper and lower sections for supporting an elastomeric seal;

b) mounting at least one high pressure valve to the apparatus in operative fluid communication with the mandrel;

c) closing the at least one high pressure valve;

d) fully opening one or more valves of the wellhead which close a passage through the wellhead;

e) applying a force to a top end of the mandrel to insert the mandrel down into the wellhead until the mandrel is in an operative position in which the lower section extends into the tubing and the elastomeric seal is in fluid sealing engagement with a tubing hanger above back pressure valve threads of the tubing hanger while the mandrel top end extends above the top of the wellhead;

f) engaging the mechanical lockdown mechanism to lock the mandrel in the operative position; and g) disengaging the mechanical lockdown mechanism, pulling up the mandrel, closing the valves of the wellhead, and removing the apparatus from the wellhead in a reverse sequence of steps a) to f) after the well treatment to stimulate production.

27. A method as claimed in claim 26 further comprising steps: before step e), mounting atop the wellhead a hydraulic cylinder that is supported in vertical and axial alignment with the wellhead by at least two elongated hydraulic cylinder support rods fixed relative to the wellhead to ensure a piston rod of the hydraulic cylinder is enabled to apply force to the top end of the mandrel; and after step f), removing the hydraulic cylinder and the support rods from the wellhead.

28. A method as claimed in claim 27 further comprising in step g) remounting the support rods and the hydraulic cylinder to the top of the wellhead to remove the mandrel, and subsequently removing the hydraulic cylinder and the support rods from the wellhead after the mandrel is withdrawn from the wellhead.

29. A method as claimed in claim 26 wherein the elastomeric seal seals against an annular step formed between lift threads and the back pressure valve threads of the tubing hanger.

30. A method as claimed in claim 26 wherein the mandrel comprises a mandrel head mounted to the top end of the mandrel, the mandrel head including a passage that has an internal diameter not smaller then the bore of the mandrel and is in fluid communication with the bore of the mandrel.

31. A method as claimed in claim 30 wherein the mandrel includes one or more mandrel extensions, each mandrel extension having a threaded top end and a threaded bottom end, the threaded top end being adapted to connect the mandrel head or another mandrel extension and the threaded bottom end being adapted to connect the mandrel or another mandrel extension.

32. A method as claimed in claim 26 wherein the force applied to the top end of the mandrel is applied by a pair of parallel, spaced beams, a lower one of which is attached to the top of the wellhead, the mandrel being attached to the upper beam and inserted into or withdrawn from the wellhead by jack assemblies which lower or raise the upper beam with respect to the lower beam.

* * * * *